United States Patent [19]

Doherty

[11] Patent Number: 4,768,966

[45] Date of Patent: Sep. 6, 1988

[54] LAMPHOLDER

[76] Inventor: Patrick J. Doherty, Suite 12, Floor 1, Hollingbrook House, Church St., Littleborough OL15 8AA, United Kingdom

[21] Appl. No.: 42,171

[22] Filed: Jun. 11, 1987

Related U.S. Application Data

[63] Continuation-in-part of Ser. No. 827,929, filed as PCT GB85/00225, May 24, 1985, published as WO85/05740, Dec. 19, 1985, abandoned.

[30] Foreign Application Priority Data

May 25, 1984 [GB] United Kingdom ..... 8413467
Jan. 30, 1985 [GB] United Kingdom ..... 8502384
Feb. 5, 1985 [GB] United Kingdom ..... 8502858

[51] Int. Cl.[4] ..... H01R 13/44

[52] U.S. Cl. ..... 439/137; 439/140; 439/360; 439/667

[58] Field of Search ..... 439/135, 136, 137, 138, 439/139, 140, 142, 144, 168, 182, 220, 280, 336, 356, 360, 375, 414, 419, 541, 558, 602, 605, 614, 615, 661–667, 702–707

[56] References Cited

U.S. PATENT DOCUMENTS 3,915,536 10/1975 Glantz ..... 339/111
4,283,102 8/1981 Richier ..... 339/42

FOREIGN PATENT DOCUMENTS 2420859 11/1979 France ..... 339/42
315106 7/1929 United Kingdom ..... 339/42

*Primary Examiner*—Gil Weidenfeld
*Assistant Examiner*—David Pirlot

[57] ABSTRACT

A lampholder for a screw-in lightbulb has a body supporting two cable terminals for connection to an electrical supply, and a contact carrier mounted on the body and defining a bulb receiving socket, the contact carrier being movable between first and second positions relative to the body in a direction parallel to the insertion direction of a bulb and supporting terminals which connect an inserted bulb to the cable terminals when the carrier is in the first position but are spaced from the cable terminals when the carrier is in the second position. A spring pushes the carrier to the second position. When a bulb is screwed part-way into the carrier socket it bears against a fixed abutment so that the carrier is moved from the second to the first positions as the bulb is screwed fully into the socket. Each cable terminal overlaps with a respective carrier terminal in the axial direction and an insulating support is provided which is fixed in position relative to one terminal of each cable/-contact terminal pair. The insulating support is such that as the carrier moves from the first to the second positions the terminal which moves is moved onto the partition and out of contact with the other terminal.

18 Claims, 14 Drawing Sheets

LAMPHOLDER

This is a continuation-in-part application based on earlier application Ser. No. 827,929, filed as PCT GB85/00225 on May 24, 1985, published as W085/05740 on Dec. 19, 1985, entitled Lampholder, now abandoned.

BACKGROUND OF THE INVENTION

The present invention relates to lampholders for receiving bulbs which are screwed in, such bulbs being generally known as Edison bulbs.

Conventional Edison type lampholders comprise a body supporting fixed terminals to which electrical cables are connected, the body defining a threaded socket into which a lamp bulb is in use screwed. The threaded portion of the socket constitutes one contact of the lampholder, the other contact being positioned axially within the socket so that the tip of the bulb screwed into the socket presses against it. Generally the contacts are permanently electrically connected to the fixed terminals.

When no bulb is present in the socket the contacts are exposed and can be easily touched. This can happen for example when replacing a faulty bulb in an overhead lampholder, or by accidentally putting ones finger in an empty socket from which a faulty bulb has been removed. Children are particularly at risk in the latter case when bedside or other free standing lampholders are provided.

Conventional three pin socket outlets into which cable terminating plugs are inserted generally have their live and neutral terminals covered by a shutter, the shutter being pulled away when an earth pin of a plug is inserted into the earth terminal socket. Such socket outlets are relatively safe as if one is to electrically contact the live terminal a pin must first be inserted into the earth terminal socket and then a further pin must be inserted into the live terminal socket. In contrast, in conventional lampholders not only are the live and neutral terminals not protected by a shutter but also the common socket in which they are located is large enough to enable a finger to be inserted.

The danger represented by conventional lampholders has been previously recognised and various attempts have been made to isolate the contacts within the socket from the cable terminals except when a bulb is present in the socket.

In one known lampholder described in European Patent Specification No. 0 077 046 a movable carrier is provided which is engaged by the thread of an inserted bulb so as to move relative to the lampholder body when a bulb is screwed in. Movement of the carrier in response to insertion of the bulb causes contacts accessible in the lampholder socket to be connected to cable terminals otherwise isolated within the lampholder body. The contacts are moved apart axially with respect to the lampholder socket so that arcing can occur if a bulb is inserted when the lampholder is connected to an electrical supply. Such arcing can seriously damage the lampholder.

It is an object of the present invention to provide an alternative safety lampholder for Edison type bulbs to that described in European Patent Specification No. 0 077 046.

SUMMARY OF THE INVENTION

According to the present invention, there is provided a lampholder for a screw-in lightbulb, comprising a body supporting two cable terminals for connection to an electrical supply, a contact carrier mounted on the body and defining a bulb receiving socket, the contact carrier being movable between first and second positions relative to the body in a direction parallel to the insertion direction of a bulb and supporting two terminals which connect an inserted bulb to the cable terminals when the carrier is in the first position but are spaced from the cable terminals when the carrier is in the second position, means for biasing the carrier to the second position, and an abutment secured to the body and extending into the carrier socket, the abutment being positioned so as to be contacted by a bulb screwed part-way into the carrier socket whereby the carrier is moved from the second to the first position when a bulb is screwed fully into the socket, wherein each cable terminal overlaps with a respective carrier terminal in the said direction and at least one terminal of each overlapping cable and carrier terminal pair is biased towards the other terminal of the pair, and an insulating support is provided with respect to each terminal pair which insulating support is fixed in position relative to one terminal of the pair and extends parallel to the said direction, the disposition and configuration of the insulating support and the terminal which moves relative to it being such that as the carrier moves from the first to the second position the said terminal which moves is moved onto the insulating support and out of contact with the other terminal.

Each insulating support may comprise a partition the dimensions of which are such that it extends between the terminals of the respective pair when the carrier is in the second position, and the configuration of which is such that as the carrier moves from the first to the second position the said terminal which moves is lifted onto the partition.

The means for biasing the carrier to the second position may comprise a compression spring positioned inside the carrier socket and bearing at one end on the carrier and at the other end on the abutment which extends into the carrier socket. The abutment member may be an axial pin around which the spring is arranged.

Alternatively, the means for biasing the carrier to the second position comprises a compression spring arranged around the outside of the carrier and bearing at one end on a lip defined by the body and at the other end on a flange defined around the outside of the carrier. In such an arrangement, the body may define an open-ended tube at one end of which the lip is defined, the spring and carrier being retained in the tube by a cable terminal carrier which is a snap fit in the end of the tube remote from the lip.

The cable terminals may define planar surfaces and the carrier terminals may comprise leaf springs having tips defining convex surfaces which bear against the planar surfaces when the carrier is in the first position.

In a further arrangement, each insulating support may comprise a surface which is a continuation in the said direction of a surface defined by said one terminal of the respective pair of terminals. The surfaces are preferably coplanar. The terminal which moves of said pair of terminals bears against the said surface defined by said one terminal when the carrier is in the first position and slides onto the said surface of the insulating support when the carrier is moved to the second position. The insulating supports may be defined by the body, and each carrier terminal may comprise a leaf spring having a tip which bears against the said surfaces of the respective carrier terminal and the respective insulating support.

The tip of each leaf spring may extend into a tubular channel defined by the body, the tubular channel defining the said surface of the respective insulating support and being penetrated by an opening receiving the respective cable terminal. Each cable terminal may be in the form of a block which is a snap fit in the respective opening.

Portions of the carrier terminals which extend into the bulb receiving socket may be spring-loaded and arranged to contact each other when the socket is empty and to be moved apart during the insertion of a bulb into the socket before the carrier has been displaced from the second position.

The carrier may support a pair of legs which project through apertures in the body, and the means for biasing the carrier to the second position may comprise a spring supported by the body and engaging the said legs. The spring may be a coil spring the ends of which project into engagement with hook formations defined by the said legs. Alternatively, the spring may be a leaf spring the ends of which are engaged in slots defined by the said legs.

DESCRIPTION OF THE DRAWINGS

Embodiments of the present invention will now be described, by way of example, with reference to the accompanying drawings, in which.

DETAILED DESCRIPTION OF THE INVENTION

Figure 1:
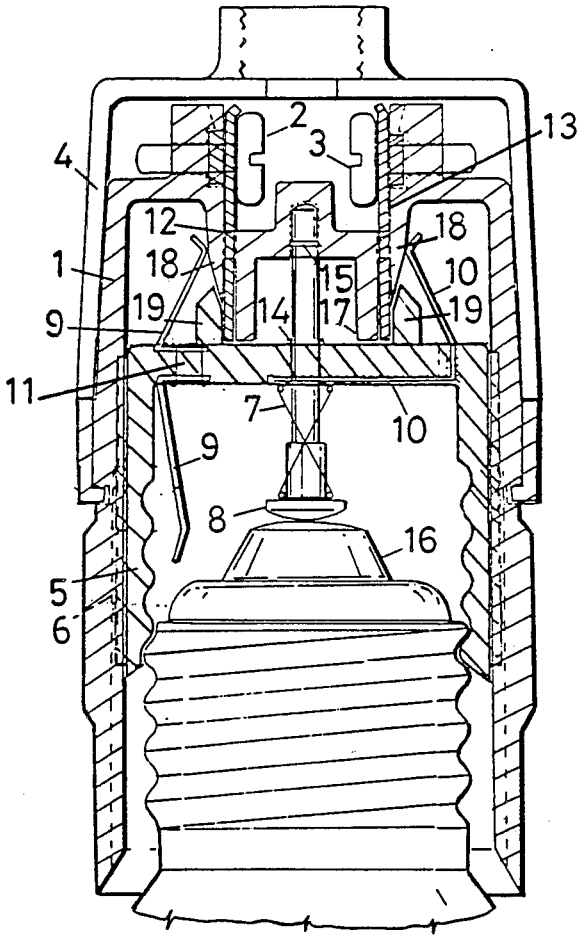
FIGS. 1 to 7 illustrate a first embodiment.
Figure 2:
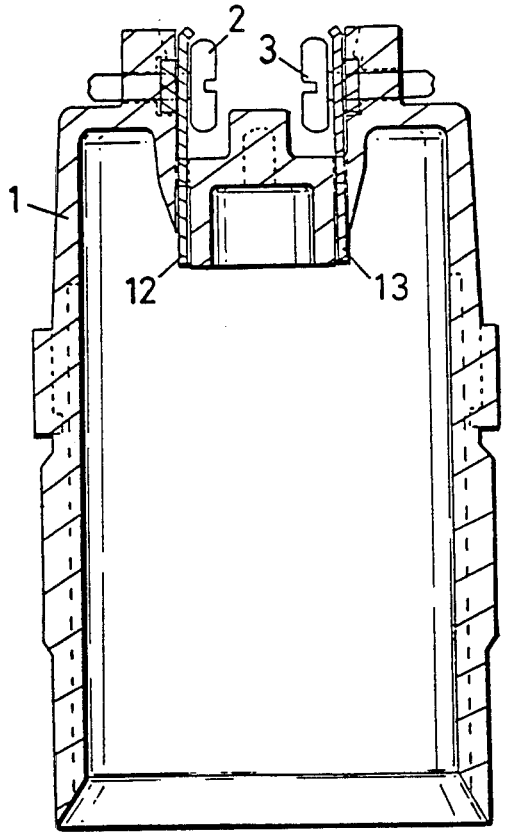

Referring to FIGS. 1 to 7, the illustrated lampholder comprises a housing 1 supporting fixed terminals 2 and 3 to which in use a cable (not shown) is connected, a cover 4 which when in position prevents access to the fixed terminals, an internally threaded carrier 5 slidable axially in a socket defined by the housing but prevented from rotating by keys 6 running in mating keyways in the housing, and a spring 7 retained on an electrically conductive rivet 8 and biasing the carrier into the socket. The carrier supports spring contacts 9 and 10, the contact 9 comprising upper and lower portions electrically connected by a rivet 11, and the contact 10 extending through the carrier so that its upper portion is electrically connected to the head of the rivet 8 via the spring 7. The terminals 2 and 3 are electrically connected to flat strips 12 and 13 which extend downwards through the housing and are seen sideways on in FIG. 1.

The rivet 8 extends through a hollow rivet 14 which holds the contact 10 on the carrier. The top of the rivet supports a barb 15 which secures the rivet within a blind bore in the housing. Thus the rivet 8 is fixed in position relative to the housing and its head defines an abutment against which will bear the tip 16 of any bulb screwed into the carrier. The bulb tip will contact the rivet 8 shortly after its threads have engaged the mating threads of the carrier. the carrier is however free to move axially against the force of the spring 7 from the position shown in FIG. 1 in which it rests against an annular stop 17 integral with the housing to a position in which the spring 7 is fully compressed between the carrier and the head of rivet 8.

In the position shown in FIG. 1, the contacts 9 and 10 are spaced from the strips 12 and 13 by partition members 18. Upstanding members 19 supported by the carrier ensure that no contact between the contacts and strips is possible once the carrier is fully retracted into the housing. As the bulb is screwed in however it contacts the rivet 8 and thereafter pulls the carrier downwards against the spring 7. As the carrier moves downwards the upper portions of the contacts 9 and 10 slide down over the members 18, and the lower portion of contact 9 comes into contact with the bulb end. When the bulb is fully screwed in, the contacts 9 and 10 bear against and are electrically connected to the strips 12 and 13 and the bulb is thus energised. If the bulb is then removed, as it is screwed out the bent upper tips of the contacts 9 and 10 ride up the sloping faces of the members 18 to break electrical contact before the bulb is fully removed.

Figure 3:
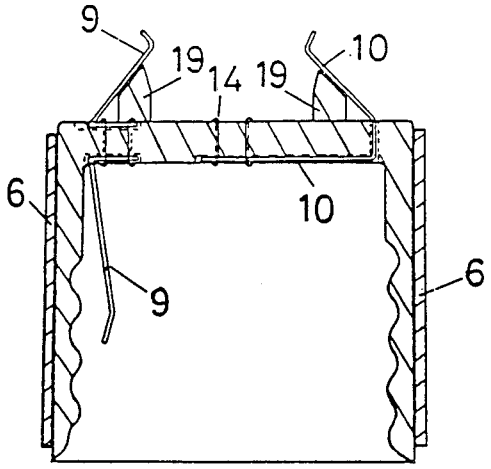
Figure 4:
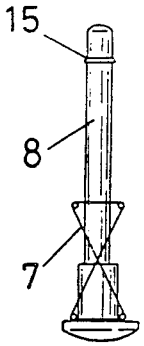
Figure 5:
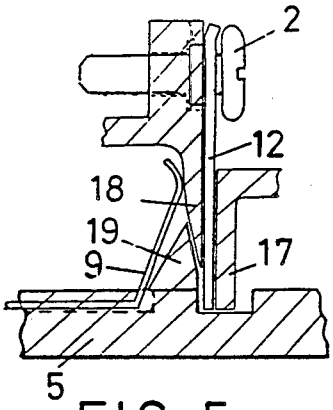
Figure 6:
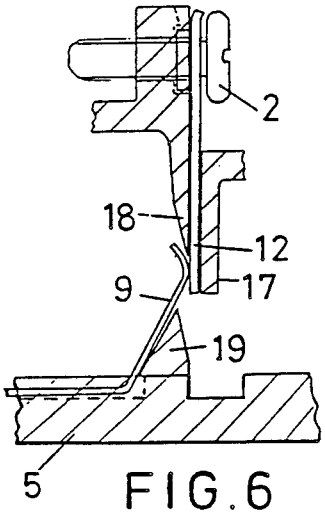
Figure 7:
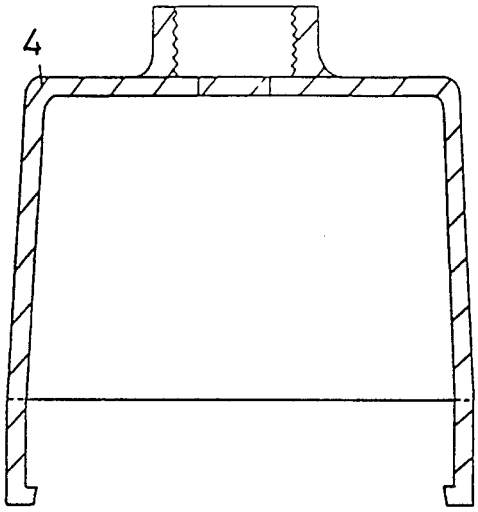
Figure 8:
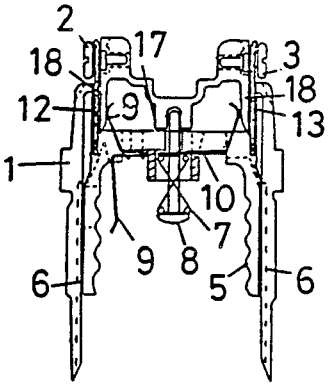
FIGS. 8 to 14 illustrate a second embodiment.
Figure 10:
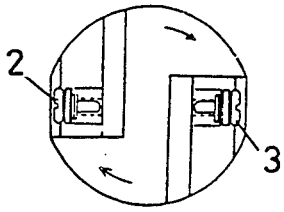
Figure 11:
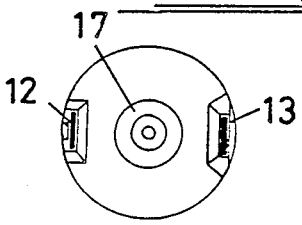
Figure 9:
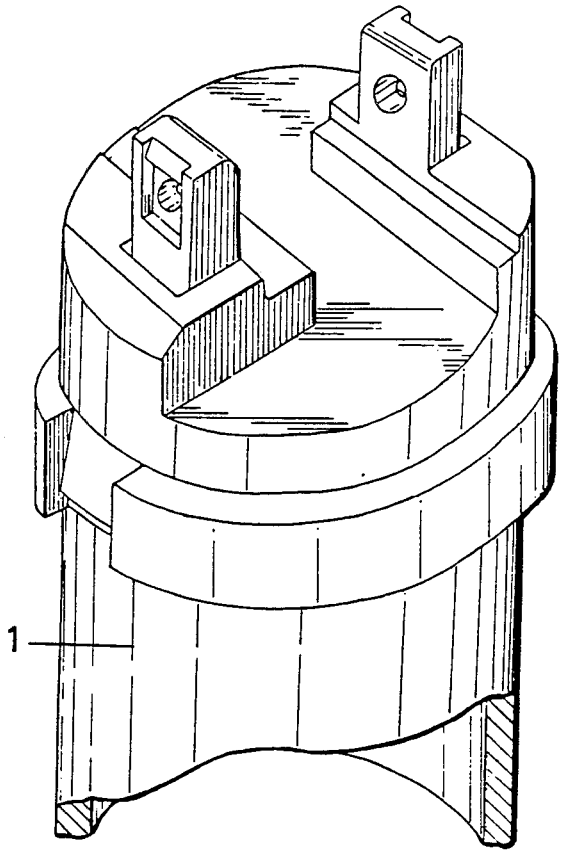

It will be appreciated that an electric shock cannot be given by the lampholder unless the carrier is pulled downwards out of the housing socket. this is very difficult to do, even if the spring 7 is relatively weak. Thus a safe lampholder can be produced which does not feel too tight. Assembly is a simple matter, and is achieved by threading the spring 7 on the rivet 8, pushing the rivet 8 through the rivet 14 in the carrier 5, and then pushing the carrier and rivet into the housing until the barb 15 on the rivet 8 engages in the housing bore. The upstanding members 19 prevent the contacts 9 and 10 springing downwards so far as to be trapped between the carrier and the housing member 17 as shown in FIG. 3.

Figure 14:
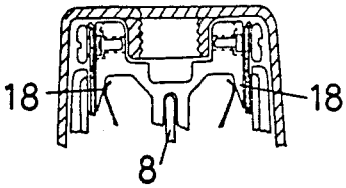
Figure 12:
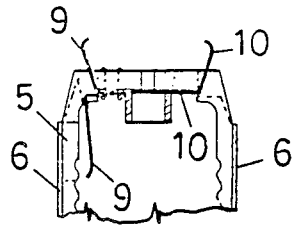
Figure 13:
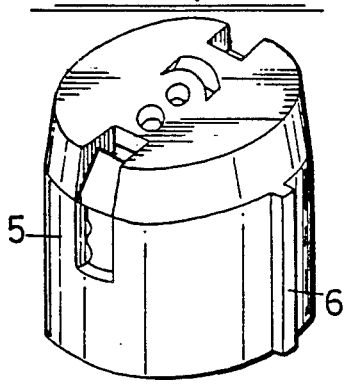
Figure 15:
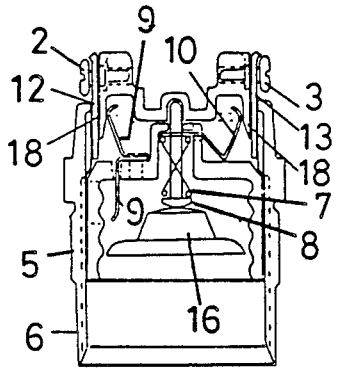
FIG. 15 illustrates a third embodiment.
Figure 16:
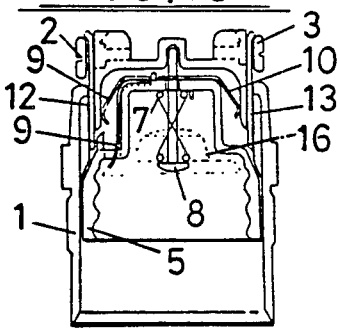
FIGS. 16 and 17 illustrate a fourth embodiment.
Figure 17:
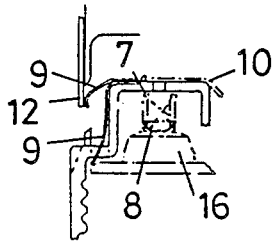

FIGS. 8 to 13 illustrate an alternative embodiment the operation of which is much the same as that of FIGS. 1 to 7 except that the contacts 9 and 10 spring radially outwards towards strips 12 and 13 rather than inwards. FIG. 14 shows another embodiment similar to that of FIGS. 8 to 13 but including a terminal cover and more sharply tapered members 18. FIG. 15 is an alternative configuration for the contacts 9 and 10 to that of FIGS. 8 to 14. FIGS. 16 and 17 show a further arrangement in which the contacts 9 and 10 spring upwards and outwards, facilitating insertion of the carrier 5 into the housing 1. FIG. 16 shows the position of the carrier before insertion of a bulb, and FIG. 17 shows (in part) the position of the carrier after insertion of the bulb.

FIGS. 18 to 27 illustrate a still further embodiment of the invention which differs from the previously described embodiments in that rather than having a compression spring arranged around an axial abutment member so as to return the carrier to a safe position the equivalent component is a compression spring arranged outside the carrier.

Figure 18:
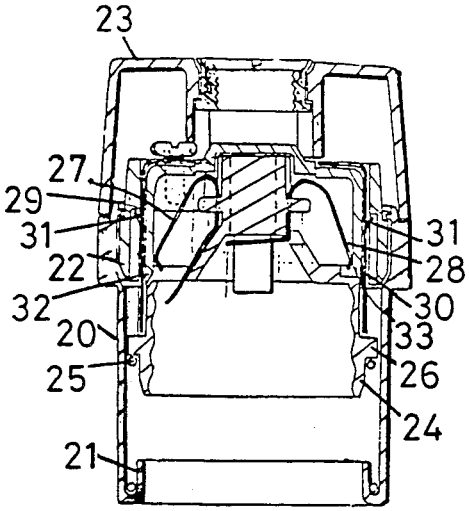
FIGS. 18 to 27 illustrate a fifth embodiment.
Figure 19:
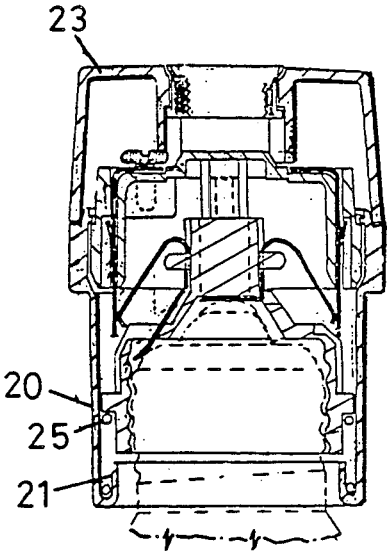

Referring in detail to the drawings, FIGS. 18 and 19 show the relative positions of the various components of the lampholder with no bulb in the lampholder (FIG. 18) and with a bulb fully screwed into the lampholder (FIG. 19). The lampholder comprises a basic body 20 in the form of an open ended tube having a J-shaped lip 21 formed at one of its open ends. A cable terminal carrier 22 is a snap-fit in the other end of the tube 20 and an end cap 23 is secured over the cable terminal carrier 22.

A contact carrier 24 is slidable within the tube 20 and is biased to the position shown in FIG. 18 by a compression spring 25 bearing at one end against the lip 21 and at the other end against a flange 26. The carrier 24 supports two leaf springs 27 and 28. The cable terminal carrier supports two cable terminals 29 and 30. The cable terminals 29 and 30 are retained in position by barbs 31 after having been pushed into appropriately shaped slots in the cable terminal carrier. The terminals 27 and 28 are also simply slipped into appropriate slots in the supporting contact carrier. Wedge shaped partitions 32 and 33 extend part way along the flat surfaces defined by the cable terminals 29 and 30 respectively and the convex tips of the carrier terminals 27 and 28 are designed to slide along the surface of the partition down the wedge shaped tip thereof and into contact with the flat surfaces of the cable terminals. As with the previously described embodiment this means that contact between the carrier terminals and the cable terminals is prevented when the carrier is in the position shown in FIG. 18.

Turning now to FIG. 19, as a bulb is inserted it pulls the carrier down against the force exerted by the compression spring 25 and the convex tips of the terminals 27 and 28 slide down the wedge shaped partitions into contact with the terminals 29 and 30. The bulb is thus connected to an electrical supply connected via a cable (not shown) to the terminals 29 and 30.

All the components of the illustrated lampholder are produced by moulding with the exception of the four terminals and the compression spring and thus although the structure of the moulds required is relatively complex the unit price of the lampholder is relatively low particularly in view of the ease of insertion of the four terminals.

Figure 20:
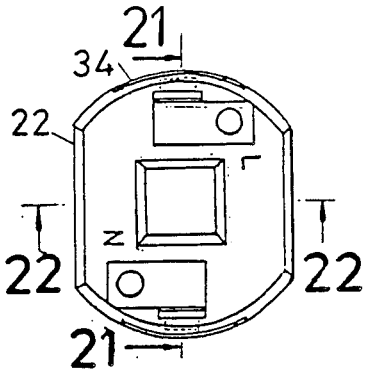
Figure 21:
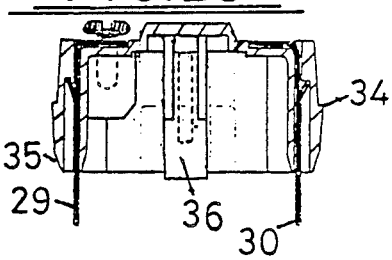
Figure 22:
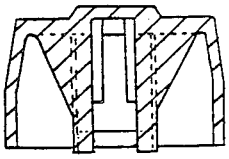

FIG. 20 is a top view of the cable terminal carrier 22 prior to insertion of the cable terminals, FIG. 21 is a section on the line 21—21 of FIG. 20 after insertion of the cable terminals 29 and 30, and FIG. 22 is a section on the line 22—22 of FIG. 20. The cable terminal carrier defines a lip 34 on each of its sides which engages behind a cooperating lip on the tubular body 20 when the cable terminal carrier is pushed into the tubular body. The edge 35 of the cable terminal carrier is tapered to facilitate its insertion into the body 20. Formations 36 provide guides for the relative movement of the contact carrier 24 and the cable terminal carrier 22.

Figure 23:
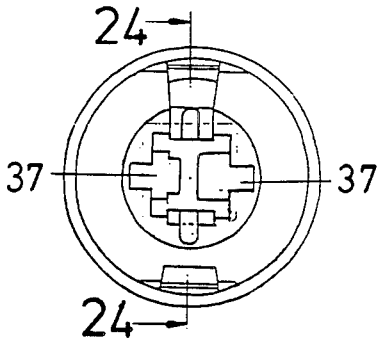
Figure 24:
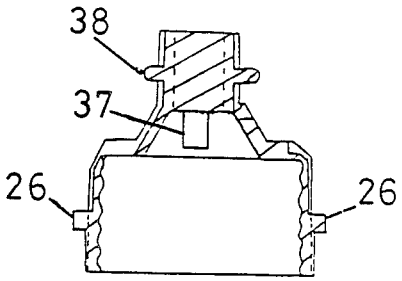

FIG. 23 is a view of the body of the contact carrier without the terminals 27 and 28 taken from the side of the contact carrier which in use is facing away from an inserted bulb and FIG. 24 is a section on the line 24—24 of FIG. 23. Formations 37 cooperate with the formations 36 on the cable terminal carrier so as to enable relative axial movement whilst preventing relative rotation. Tubular projections 38 are provided to retain the terminals 27 and 28 (FIG. 18) in position on the contact carrier.

Figure 26:
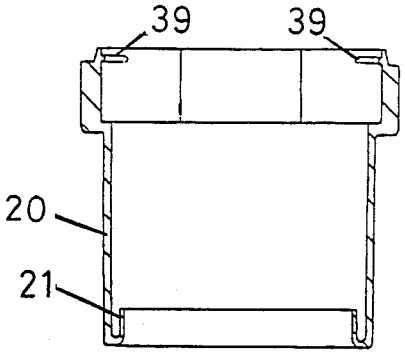
Figure 27:
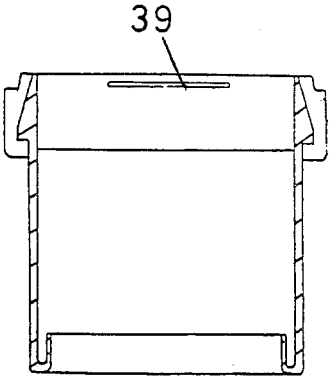
Figure 25:
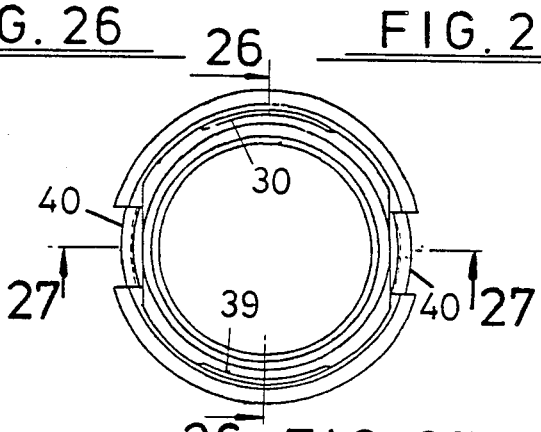

FIGS. 25 to 27 illustrate details of the lampholder body 20, FIGS. 26 and 27 being sections on the lines 26—26 and 27—27 respectively of FIG. 25. Lips 39 are shown which cooperate with the complementary formations 34 on the cable terminal carrier to retain the cable terminal carrier within the body 20. Cutouts 40 are provided to enable hook-like members on the cover 23 (not shown) to engage the body 20 and thereby retain the cover in position.

The particular advantage of the embodiment according to FIGS. 18 to 27 is its ease of assembly. This is achieved simply by holding the tubular body 20 with the lip 21 downwards, dropping the spring 25 into the body 20 so that it engages the lip 21, pushing the contact carrier 24 down onto the spring 25, and then pushing the cable terminal carrier 22 down onto the carrier until the complementary formations 34 (FIG. 21) and 39 (FIG. 25) engage.

Figure 28:
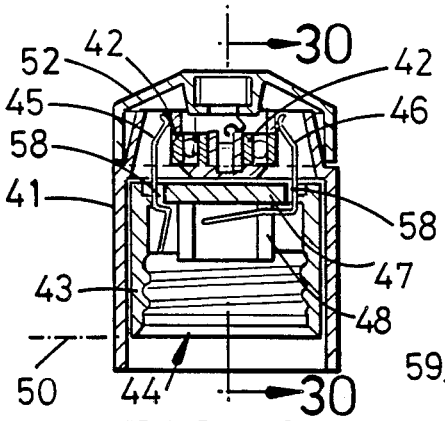
FIGS. 28 to 43 illustrate a sixth embodiment.
Figure 29:
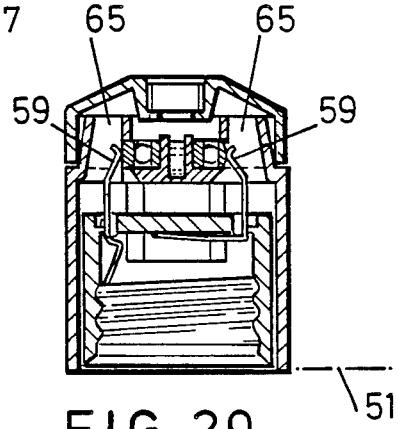
Figure 30:
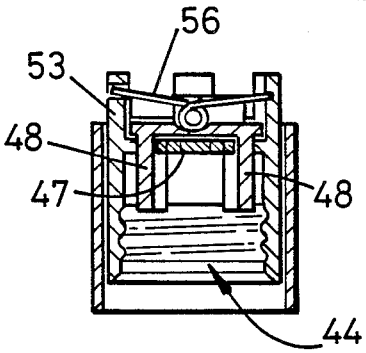
Figure 31:
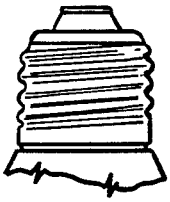
Figure 32:
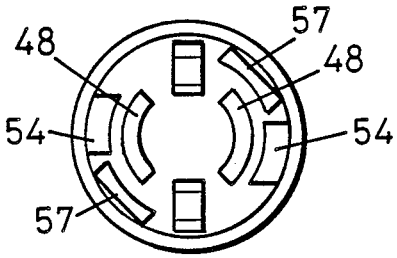
Figure 33:
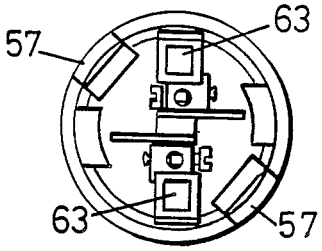
Figure 34:
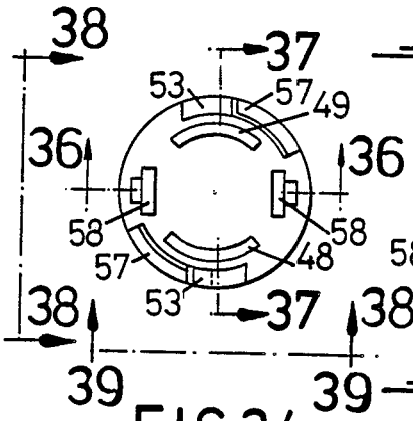
Figure 35:
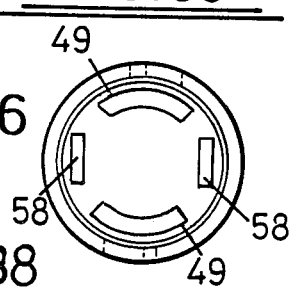
Figure 36:
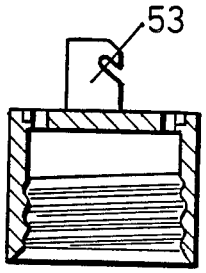
Figure 38:
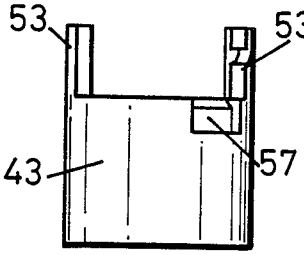
Figure 39:
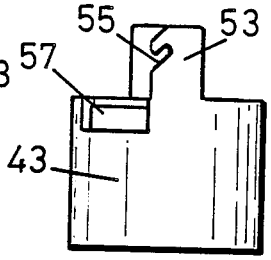
Figure 37:
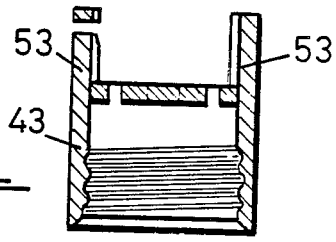

Referring now to FIGS. 28 to 43, a sixth embodiment of the present invention is illustrated. FIGS. 28 and 29 show similar views of the embodiment with the relative orientation of the various components corresponding to no bulb being inserted (FIG. 28) and a bulb inserted (FIG. 29). The view of FIG. 30 is of the components in the position shown in FIG. 28 but taken on the line 30—30 of FIG. 28. FIG. 31 illustrates the tip of a bulb intended for insertion into the lampholder. FIGS. 32 and 33 are respectively inside and top views of the body, FIGS. 34 and 35 are respectively top and underside views of the carrier, FIGS. 36 to 39 are views on the line 36—36, 37—37, 38—38 and 39—39 of FIG. 34, and FIGS. 40 to 43 are perspective views of terminals and springs incorporated in the mechanism.

Referring to FIGS. 28 to 43 the illustrated embodiment comprises a body 41 supporting cable terminals 42 and a contact carrier 43. The contact carrier defines a bulb receiving socket 44 which is threaded to receive the threaded tip of an Edison-type lamp bulb as illustrated in FIG. 31. The carrier supports carrier terminals 45 and 46 which extend through and project on either side of a base portion 47 of the carrier.

The body supports two arcuate walls 48 which extend through mating apertures 49 in the carrier and serve as guides for the axial movement of the carrier. When no bulb is present in the lampholder the rim of the socket 44 is aligned with the line 50 in FIG. 28. When a bulb is inserted into the socket 44 its tip bears against the bottom edge of the walls 48 and as a result the carrier is drawn down onto the tip of the bulb to assume the position illustrated in FIG. 29 in which the bottom rim of the carrier is roughly in line with the line 51. A cover 52 is secured on the upper end of the body 41 and thus in the absence of a bulb when the mechanism assumes the position shown in FIG. 28 there is no direct access to the terminals 42 and the carrier terminals 45 and 46 are out of contact with the terminals 42 and accordingly electrically isolated.

As can be seen from FIG. 30, the carrier comprises integral legs 53 which project through apertures 54 in the body. The ends of the legs 53 define hooks 55 (FIG. 39) which engage over the ends of a coil spring 56. Thus the spring 56 not only biases the carrier to the position shown in FIG. 28 but in addition prevents the removal of the carrier from the body.

The cover 52 is retained in position by hook members (not shown) which engage in cut-outs 57 provided in the body. Thus assembly of the mechanism is a simple matter, it merely being necessary to drop the carrier into the body so that the legs extend through the apertures 54, positioning the spring 56 so as to engage the hooks 55, and snapping the cover into engagement with the cut-outs 57.

Figure 40:
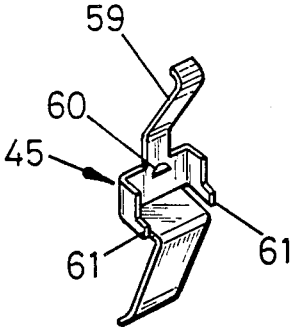

The detailed structure of the terminals illustrated in FIG. 28 will now be described with reference to FIGS. 40 to 42. FIG. 40 illustrates the carrier terminal 45 which in use is inserted into one of a pair of terminal slots 58 provided in the carrier. The terminal 45 is inserted by pushing a spring arm 59 through the respective slot 58 until a pressed out portion 60 of the terminal engages over a lip defined by the aperture 58. The terminal can then not be removed from the carrier without the application of considerable force. Furthermore the terminal cannot be pushed through the aperture 58 because of the provision of fingers 61 which engage underneath the base portion of the carrier.

Figure 41:
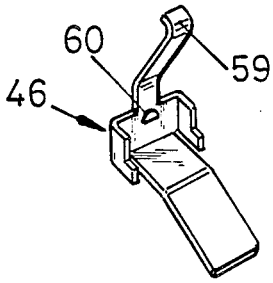

Referring now to FIG. 41, the illustrated terminal 46 is similar to that illustrated in FIG. 40 except for the fact that the portion of the terminal which projects inside the carrier extends across the base portion of the carrier rather than parallel to the threaded carrier wall. The terminal of FIG. 41 is retained in position by a pressed out portion 60 as in the case of the terminal of FIG. 40 and again comprises a spring arm 59, the two spring arms 59 being biased towards each other in the free state of the carrier.

Figure 42:
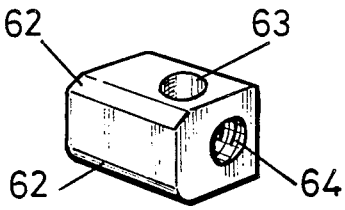

FIG. 42 illustrates a terminal block 42. The terminal block has chamferred edges 62, a wire receiving bore 63 and a threaded bore 64 which receives a screw to trap an inserted wire in the bore 63.

As can best be seen from FIGS. 29 and 33, the spring arms of the carrier terminals are slidable within tubular channels 65 which are penetrated by openings into which the terminals 42 are inserted. The terminals are pushed in to the openings such that one side of each terminal defines a surface that is a coplanar continuation of an insulating surface defined by the respective tubular channel 65.

When no bulb is present in the lampholder the various components assume the relative positions illustrated in FIG. 28. The spring arms 59 accordingly bear against insulating surfaces defined by the tubular channels 65. As a bulb is inserted however its tip bears against the walls 48 and the carrier 43 is then drawn down onto the bulb. This causes the terminals 45 and 46 to move down with the carrier so that the spring arms slide along the inside walls of the tubular channels 65 until they come to rest as shown in FIG. 29 in contact with the terminal blocks 42. Thus when there is no bulb present in the socket 44 the terminals 45 and 46 are electrically isolated. It is only after a bulb has been partially screwed in that the terminals become live. An inherently safe structure accordingly results.

Figure 44:
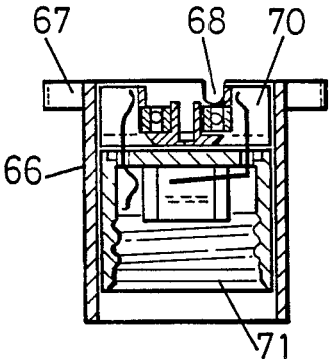
FIGS. 44 to 46 illustrate a seventh embodiment.
Figure 45:
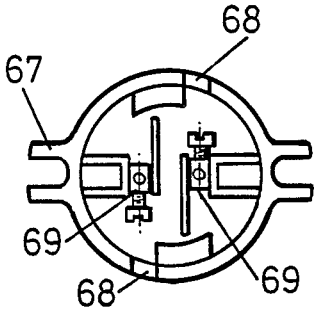
Figure 46:
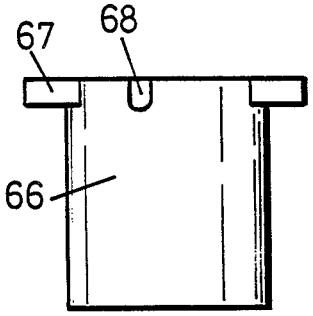
Figure 43:
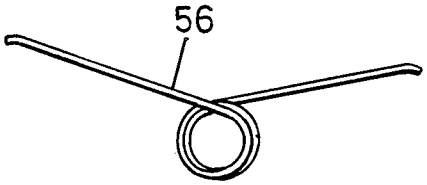

FIGS. 44 to 46 illustrate a seventh embodiment of the present invention which incorporates a mechanism substantially identical to that illustrated in FIGS. 28 to 43 but which is supported in an alternative body of the type suitable for surface mounting in for example an open-air light display. The arrangement of FIGS. 44 to 46 comprises an outer tubular shell which is of very simple structure and can accordingly be manufactured from for example porcelain. The outer shell comprises a tubular sleeve 66 supporting lugs 67 which enable the sleeve to be secured on an appropriate surface using for example screws. The sleeve 66 defines on its lower edge slots 68 through which a supply cable can be fed to terminals 69. The terminals are supported in a simple body 70 on which a carrier 71 is mounted. The functionally interrelated formations of the body 70 and carrier 71 are substantially identical to those of the embodiment according to FIGS. 28 to 43.

With the arrangement of FIGS. 44 to 46 a cable can be connected to a series of safety lampholders in a simple manner and the cable and lampholders can then be mounted on for example a supporting board simply by slipping sleeves 67 over each lampholder and securing the sleeves in position using screws. The cables engaged in the slots 68 retain the safety lampholder mechanism within the sleeve.

Figure 48:
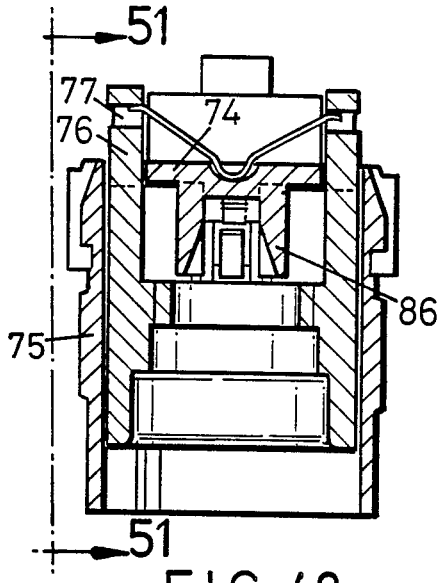
FIGS. 47 to 57 illustrate an eighth embodiment.
Figure 50:
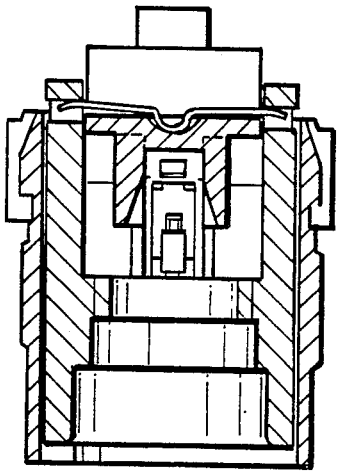
Figure 47:
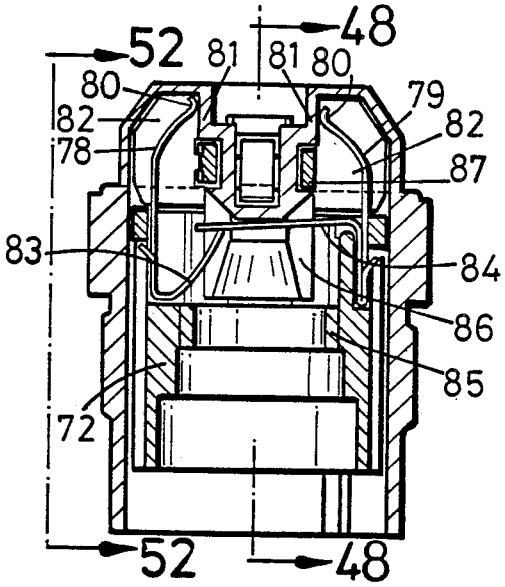
Figure 49:
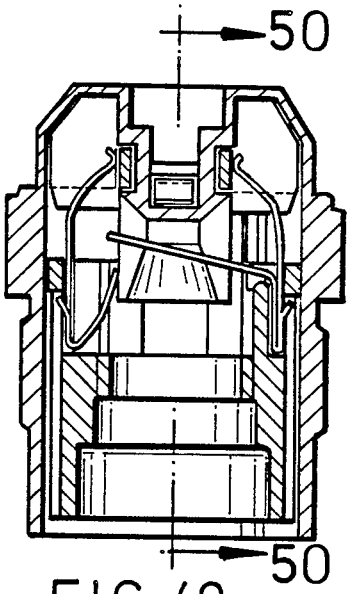
Figure 51:
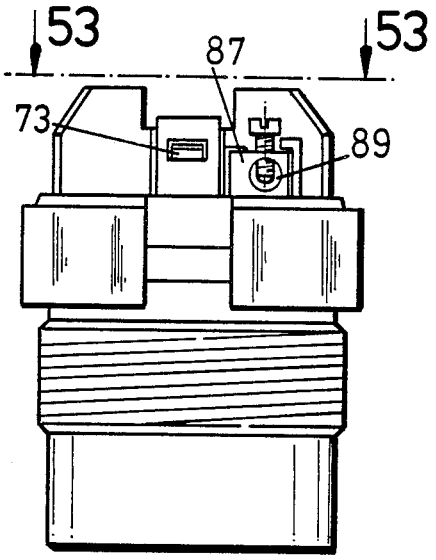
Figure 52:
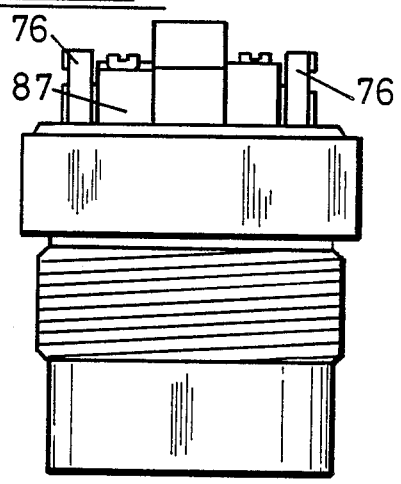
Figure 53:
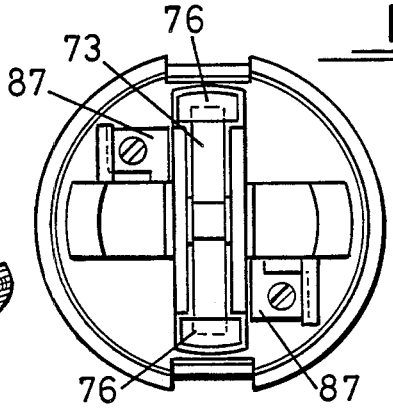

Referring now to FIGS. 47 to 57, an eighth embodiment of the invention will now be described. FIG. 47 is a sectional view through the embodiment showing the relative position of the various components when no bulb is present and FIG. 48 is a section on the lines 48—48 of FIG. 47. FIG. 49 is a view corresponding to that of FIG. 47 but after the insertion of a bulb has displaced the carrier within the lampholder body and FIG. 50 is a section on the lines 50—50 of FIG. 49. FIG. 51 is a view on the lines 51—51 of FIG. 48 and FIG. 52 is a view on the lines 52—52 of FIG. 47. FIG. 53 is a view from above of the body component of the embodiment and FIGS. 54 to 57 illustrate terminals and spring members incorporated in the embodiment.

Referring to FIGS. 47 and 48, when no bulb is present in the lampholder a carrier 72 is urged by a leaf spring 73 into contact with an upper portion 74 of a body 75. The carrier supports legs 76 defining apertures 77 into which the ends of the leaf spring 73 are inserted. Thus the spring 73 biases the carrier to the position shown and prevents it being removed from the body.

The carrier 72 supports terminals 78 and 79 defining spring arms the tips 80 of which bear against insulating surfaces 81 defined within tubular channels 82. The other ends of the terminals 78 and 79 define spring arms 83 and 84 which are biased into contact with each other.

When a bulb is inserted into the socket defined by the carrier a threaded tip on the bulb engages a threaded portion 85 of the carrier and the bulb tip engages a pair of walls 86 which project through a base portion of the carrier. The electrode on the very tip of the bulb contacts the spring arm 84 and as the bulb is rotated the carrier is drawn onto it but the spring arm 84 is pushed upwards (in FIG. 47) by the bulb tip and therefore moves out of contact with a spring arm 83. As the carrier is pulled down the spring arms 80 slide along the insulating surfaces 81 and onto terminals 87 the surfaces of which are coplanar with and form continuations of the surfaces 81. The assembly is then in the position shown in FIG. 49 in which the terminals 78 and 79 are in contact with the terminals 87 and accordingly connected to any supply voltage applied to those terminals.

Figure 54:
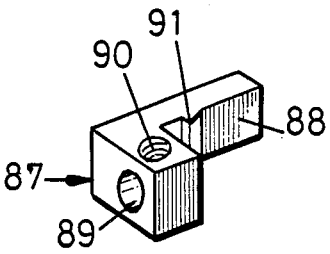

FIG. 54 illustrates the structure of the cable terminals 87. The surface 88 of the terminals is that against which the swing arms 80 bear when a bulb is inserted. A bore 89 is provided to receive the end of a cable and a bore 90 is provided to receive a screw which can clamp the cable within the terminal 87. A projection 91 is provided for engagement with a mating surface (not shown) on the lampholder body so that the terminals are retained in position after being pushed into the desired position.

Figure 55:
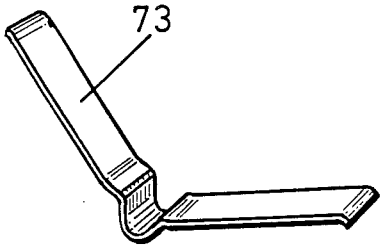
Figure 56:
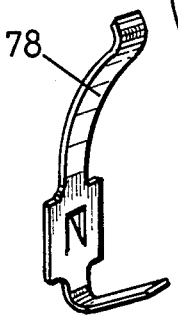
Figure 57:
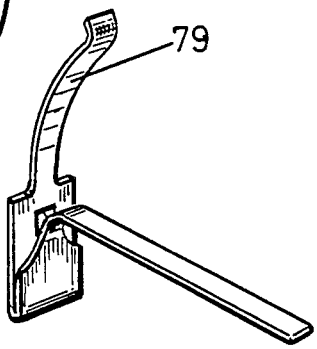

FIG. 55 illustrates the spring 73 in its free condition. FIG. 56 illustrates the carrier terminal 78 which incorporates a pressed out portion 92 that engages the carrier after insertion of the terminal and thereby prevents its removal. A similar pressed out portion 93 is provided on the terminal 79 which is illustrated in FIG. 57.

With the embodiment of FIGS. 47 to 57 the carrier terminals are shorted out whenever the lampholder does not incorporate a bulb. This means that even if the carrier terminals are welded to the cable terminals or for some reason the carrier becomes jammed in the position it normally assumes only when a bulb is inserted the worst that can happen is that the mains fuse of the power supply to the lampholder is blown as a result of the shorting out of the cable terminals. In no event can the accessible portions of the carrier terminals be live and also accessible due to the absence of a bulb. To ensure that the carrier terminal 84 contacts the terminal 83 when there is no bulb in the socket a compression spring (not shown) could be positioned behind the terminal 84 so as to bias the terminal 84 towards the terminal 83.

I claim:

1. A lampholder for a screw-in lightbulb, comprising a body supporting two cable terminals for connection to an electrical supply, a contact carrier mounted on the body and defining a bulb receiving socket, the contact carrier being movable between first and second positions relative to the body in a direction parallel to the insertion direction of a bulb and supporting two terminals which connect an inserted bulb to the cable terminals when the carrier is in the first position but are spaced from the cable terminals when the carrier is in the second position, means for biasing the carrier to the second position, and an abutment secured to the body and extending into the carrier socket, the abutment being positioned so as to be contacted by a bulb screwed part-way into the carrier socket whereby the carrier is moved from the second to the first position when a bulb is screwed fully into the socket, wherein each cable terminal overlaps with a respective carrier terminal in the said direction and at least one terminal of each overlapping cable and carrier terminal pair is biased towards the other terminal of the pair, and an insulating support is provided with respect to each terminal pair which insulating support is fixed in position relative to one terminal of the pair and extends parallel to the said direction, the disposition and configuration of the insulating support and the terminal which moves relative to it being such that as the carrier moves from the first to the second position the said terminal which moves is moved onto the insulating support and out of contact with the other terminal.

2. A lampholder according to claim 1, wherein each insulating support comprises a partition the dimensions of which are such that it extends between the terminals of the respective pair of terminals when the carrier is in the second position, and the configuration of which is such that as the carrier moves from the first to the second position the said terminal which moves is lifted onto the partition.

3. A lampholder according to claim 2, wherein the cable terminals define planar surfaces extending substantially parallel to the socket axis, the partitions are wedge-shaped tapering down to terminate part-way along the planar surfaces towards the carrier, and the carrier terminals comprise leaf springs having tips defining convex surfaces which slide across the planar surfaces and onto the wedge-shaped partitions as the carrier moves from the first position towards the second position.

4. A lampholder according to claim 2, wherein the means for biasing the carrier to the second position comprises a compression spring positioned inside the carrier socket and bearing at one end on the carrier and at the other end on the abutment which extends into the carrier socket.

5. A lampholder according to claim 4, wherein the body defines a socket having a closed end through which the cable terminals extend, the carrier is slidable into the body socket through the open end thereof, and the abutment comprises a pin around which the compression spring is arranged, the pin having an enlarged head against which the said other end of the spring bears, and the pin extending through the carrier into secure engagement with the body so as to retain the carrier in the body socket.

6. A lampholder according to claim 1, wherein the means for biasing the carrier to the second position comprises a compression spring arranged around the outside of the carrier and bearing at one end on a lip defined by the body and at the other end on a flange defined around the outside of the carrier.

7. A lampholder according to claim 6, wherein the body defines an open-ended tube at one end of which the said lip is defined, the spring and carrier are slidable into the body from the end of the tube remote from the lip, and a cable terminal carrier is provided which is a snap fit in the end of the tube remote from the lip so as to retain the carrier and spring in the body.

8. A lampholder according to claim 1, wherein each insulating support comprises a surface which is a continuation in the said direction of a surface defined by said one terminal of the respective pair of terminals, the terminal which moves of said pair of terminals bearing against the said surface defined by said one terminal when the carrier is in the first position and sliding onto the said surface of the insulating support when the carrier is moved to the second position.

9. A lampholder according to claim 8, wherein the said surfaces of the terminals and the insulating supports are aligned planar surfaces.

10. A lampholder according to claim 8, wherein the abutment comprises two walls projecting through slots formed in a base portion of the carrier to contact the tip of an inserted bulb, the walls being equally spaced from a central axis of the carrier.

11. A lampholder according to claim 8, wherein the insulating supports are defined by the body and each carrier terminal comprises a leaf spring having a tip which bears against the said surfaces of the respective carrier terminal and the respective insulating support.

12. A lampholder according to claim 11, wherein each carrier terminal is a snap fit in a respective aperture in a base portion of the carrier.

13. A lampholder according to claim 11, wherein portions of the carrier terminals which extend into the bulb receiving socket are spring-loaded and arranged to contact each other when the socket is empty and to be moved apart during the insertion of a bulb into the socket before the carrier has been displaced from the second position.

14. A lampholder according to claim 11, wherein the tip of each leaf spring extends into a tubular channel defined by the body, the tubular channel defining the said surface of the respective insulating support and being penetrated by an opening receiving the respective cable terminal.

15. A lampholder according to claim 14, wherein each cable terminal is in the form of a block which is a snap fit in the respective opening.

16. A lampholder according to claim 1, wherein the carrier supports a pair of legs which project through apertures in the body, and the means for biasing the carrier to the second position comprises a spring supported by the body and engaging the said legs.

17. A lampholder according to claim 16, wherein the spring is a coil spring the ends of which project into engagement with hook formations defined by the said legs.

18. A lampholder according to claim 16, wherein the spring is a leaf spring the ends of which are engaged in slots defined by the said legs.

* * * * *